US007310848B2

(12) United States Patent
Lepoittevin et al.

(10) Patent No.: US 7,310,848 B2
(45) Date of Patent: Dec. 25, 2007

(54) TOOTHBRUSH PROVIDED WITH AN ARTICULATED ARM BEARING A PROTECTIVE CAP

(75) Inventors: David Lepoittevin, Paris (FR); Francois Lhuisset, Mongeron (FR); Denis Plainchamp, Paris (FR)

(73) Assignee: Sanofi-Aventis, Paris (FR)

( * ) Notice: Subject to any disclaimer, the term of this patent is extended or adjusted under 35 U.S.C. 154(b) by 268 days.

(21) Appl. No.: 10/496,562

(22) PCT Filed: Nov. 14, 2002

(86) PCT No.: PCT/FR02/03895

§ 371 (c)(1),
(2), (4) Date: Nov. 1, 2004

(87) PCT Pub. No.: WO03/043460

PCT Pub. Date: May 30, 2003

(65) Prior Publication Data

US 2005/0039283 A1 Feb. 24, 2005

(30) Foreign Application Priority Data

Nov. 22, 2001 (FR) ..... 01 15103

(51) Int. Cl.
*A46B 17/04* (2006.01)

(52) U.S. Cl. ..... 15/185; 15/184; 132/308; 132/311

(58) Field of Classification Search ..... 15/184, 15/185, 247; 132/309, 311; 401/191
See application file for complete search history.

(56) References Cited

U.S. PATENT DOCUMENTS

| | | | | |
|---|---|---|---|---|
| 396,898 | A | 1/1889 | Smith | |
| 1,104,365 | A | 7/1914 | Loughlin | |
| 1,967,775 | A * | 7/1934 | Kantor | 15/185 |
| 2,678,459 | A * | 5/1954 | Stuckey | 15/185 |
| 4,482,263 | A | 11/1984 | Palamara | |
| 6,551,001 | B2 * | 4/2003 | Aberegg et al. | 401/190 |

FOREIGN PATENT DOCUMENTS

| | | | |
|---|---|---|---|
| CH | 288 123 | 5/1953 | |
| DE | 298 20 992 | 1/1999 | |
| FR | 2 615 372 | 11/1988 | |
| GB | 2 223 398 | 4/1990 | |
| WO | WO90/12522 | 11/1990 | |
| WO | WO9012522 A1 * | 11/1990 | 15/184 |

* cited by examiner

*Primary Examiner*—Shay Karls
(74) *Attorney, Agent, or Firm*—Young & Thompson

(57) ABSTRACT

A toothbrush having a head placed at a front longitudinal end of a handle made overall as a single piece. The head has flexible brushing elements on its upper surface. The toothbrush is equipped with an arm articulated at one end, and provided at the opposite free end with a protective cover for the brushing elements. The general thickness of the arm gradually increases from its articulation end to the cover so as to form a profile projecting from a longitudinal surface of the rear portion of the handle, by virtue of which the gripping surface of the handle is increased. The articulation of the arm on the handle is designed to allow it to describe at least two different rotations about two substantially orthogonal geometric axes.

6 Claims, 2 Drawing Sheets

72 74 14 36 30 26 50 32 34 22 28 10
X
2
P2 76 70 52 12

20 16 74 70 30 34 32 22 28 10
72
P1 18 14 26 50 38 24 12

16 14 72 36 30 26 A1 34 22 10
20 28 12

36 74 30 70
20 50 A2 A1 22 10
14 38 24 12

14 26 A1 22 10
A2 12

30 36 72

TOOTHBRUSH PROVIDED WITH AN ARTICULATED ARM BEARING A PROTECTIVE CAP

FIELD OF THE INVENTION

The invention relates to a toothbrush.

The invention relates more particularly to a toothbrush comprising a head placed at a front longitudinal end of a handle made overall as a single piece, of the type in which the head has flexible brushing elements on its upper surface, of the type which is equipped with an arm articulated at one end midway along the handle, and provided at the opposite free end with a protective cover for the brushing elements, such that the articulated arm can assume:

a forward protective position in which the arm is adjacent a front portion of the handle and in which the cover covers the brushing elements;

and a rear gripping position in which the arm is adjacent a rear portion of the handle;

of the type in which the general thickness of the arm gradually increases from is articulation end to the cover so as to form a profile projecting from a longitudinal surface of the rear portion of the handle, when the arm is in the gripping position, by virtue of which the gripping surface of the handle is increased.

By way of definition, the "head" of a toothbrush will refer to the overall distal end part, placed at the free end of the handle for gripping and manipulating the toothbrush and bearing the flexible brushing elements, such as bristles.

BACKGROUND OF THE INVENTION

Many toothbrush models are already known that can be folded to facilitate transport, sometimes called "travel toothbrushes". The main aim of this type of toothbrush is to be as compact as possible, in the folded position, while allowing normal use of the toothbrush in the unfolded position. Generally, these toothbrushes also comprise means for protecting the flexible brushing elements during transport in the folded position.

A toothbrush of this type is disclosed in document FR-A-2 615 372.

This toothbrush comprises a case made up of two folding parts and a handle at whose free end is placed the brush head.

The handle is mounted so as to pivot at an articulation end of a first part of the case about a substantially vertical axis.

In the folded position, the handle and the first case part are aligned longitudinally and the case surrounds part of the head while leaving an opening in a longitudinal side wall so as to allow the brush filaments to pass out through the side of the case when the handle goes from the folded to the unfolded position, and vice versa.

The toothbrush also comprises a second case part which is articulated, about a horizontal transverse axis, at the end of the first case part opposite to the vertical pivoting axis.

In the folded position, the second case part covers the first case part and closes off the opening, so that the case completely protects the flexible brushing elements in this position.

To unfold the toothbrush, into the use position, it is therefore necessary to first of all pivot the second case part about its transverse articulation axis to uncover the opening, and then the handle is pivoted one half-turn about its vertical axis, the brushing filaments passing through the opening.

Lastly, the second case part is pivoted into its original position, so that it locks the handle in the brushing position.

One advantage of this type of toothbrush lies in its gripping surface, which is relatively large, thus facilitating manipulation and improving ergonomics during brushing.

However, this type of toothbrush has several disadvantages.

This type of toothbrush is relatively difficult to produce since the brush comprises at least three separate elements that require assembly.

The articulation of the two case parts is difficult to achieve and fragile. When the brush is used, the second case part may thus easily become detached from the first part, either as a result of breakage of the articulation means or of their coming apart, if these articulation means are achieved by elastic fitting-together. There is therefore the risk of losing the second case part or of no longer being able to use it.

However, in order to be able to use the toothbrush properly it is necessary to have the two case parts since they serve both to ensure complete protection of the brushing filaments and to lock the handle in the brushing position.

Consequently, loss of the second case part renders the toothbrush practically unusable.

Furthermore, during brushing, the user holds the toothbrush by the case. The quality of the mounting of the articulated end of the handle in the case therefore has a significant effect on the overall rigidity of the toothbrush, and hence on the quality of the brushing.

In particular, the play that may arise at the join between the handle and the case may hinder use.

Another type of toothbrush has been proposed by document WO-A-90/12522. According to this document, the toothbrush has a handle made as a single piece with the head and provided, on its upper surface, with a longitudinal groove. A longitudinal pivoting arm is mounted so as to pivot at one end about a horizontal transverse axis midway along the longitudinal groove and has, at its opposite longitudinal end, a protective cover.

When the pivoting arm is in a protective position, it lies longitudinally inside a front portion of the groove and the cover covers the brushing filaments of the brush head.

When the pivoting arm is in a brushing position, it lies longitudinally inside a rear portion of the groove and the protective cover extends longitudinally to the rear of the handle.

Unlike the toothbrush of the first document cited, the toothbrush of the second document is of more simple design since it comprises only two parts. Furthermore, this toothbrush may be used without the articulated arm since it does not form a gripping surface with the rest of the handle.

However, the surface for gripping the toothbrush during brushing is relatively small with respect to the toothbrush of the first document. This small gripping surface is disadvantageous, especially when the user wishes to perform a "rolling" brushing action.

According to this brushing technique, also called the Stillman technique, and to variations of this technique, the user imparts to the toothbrush a movement in which the longitudinal axis of the head stays generally parallel to the dental arch and in which the head describes both a rotation and a translation, so as to perform a brushing action starting at the gum and continuing as far as the tips of the teeth.

SUMMARY OF THE INVENTION

The invention aims to overcome these drawbacks by providing a novel toothbrush design which is more simple and therefore more economical, and which has a gripping surface that is relatively large during brushing.

For this purpose, the invention provides a toothbrush comprising a head placed at a front longitudinal end of a handle made overall as a single piece, of the type in which the head has flexible brushing elements on its upper surface, of the type which is equipped with an arm articulated at one end midway along the handle, and provided at the opposite free end with a protective cover for the brushing elements, such that the articulated arm can assume:

a forward protective position in which the arm is adjacent a front portion of the handle and in which the cover covers the brushing elements;

and a rear gripping position in which the arm is adjacent a rear portion of the handle;

of the type in which the general thickness of the arm gradually increases from its articulation end to the cover so as to form a profile projecting from a longitudinal surface of the rear portion of the handle, when the arm is in the gripping position, by virtue of which the gripping surface of the handle is increased, characterized in that the articulation of the arm on the handle is designed to allow the arm to describe at least two different rotations:

a first rotation about a first geometric axis, substantially orthogonal to the longitudinal plane defined by the upper surface of the head; and a second rotation about a second geometric axis, substantially orthogonal to the first axis of rotation.

According to other features of the invention:

the arm is articulated on an upper portion of the handle via a ball-type connection;

the articulation end of the arm comprises a ball, and this ball is force-fitted in a recess of complementary shape made in the upper portion of the handle;

the ball is integral, by molding as a single piece, with the arm and the cover;

the arm comprises means for locking via elastic fitting-together of complementary shapes, so as to lock the arm at least in its protective position;

the arm comprises two longitudinal wings which, when the arm is in the protective position or the gripping position, extend vertically downward on either side of the handle, and which each have, on their inside face, a boss designed to cooperate with a complementary relief on the side surface facing the handle, so as to lock the arm in the relevant position;

the arm has a stop element which, when the arm is in the protective position, extends toward an upper portion of the handle, so as to prevent the brushing elements from being crushed by the cover;

the flexible brushing elements consist of brushing filaments, or bristles, and the height of the filaments increases from each longitudinal side edge of the head toward a longitudinal mid-plane that is substantially orthogonal to the upper surface of the head.

BRIEF DESCRIPTION OF THE DRAWINGS

Other features and advantages of the invention will emerge on reading the following detailed description in conjunction with the attached drawings, in which.

DETAILED DESCRIPTION OF THE INVENTION

Figures 1, 2, 3, 4, 5:
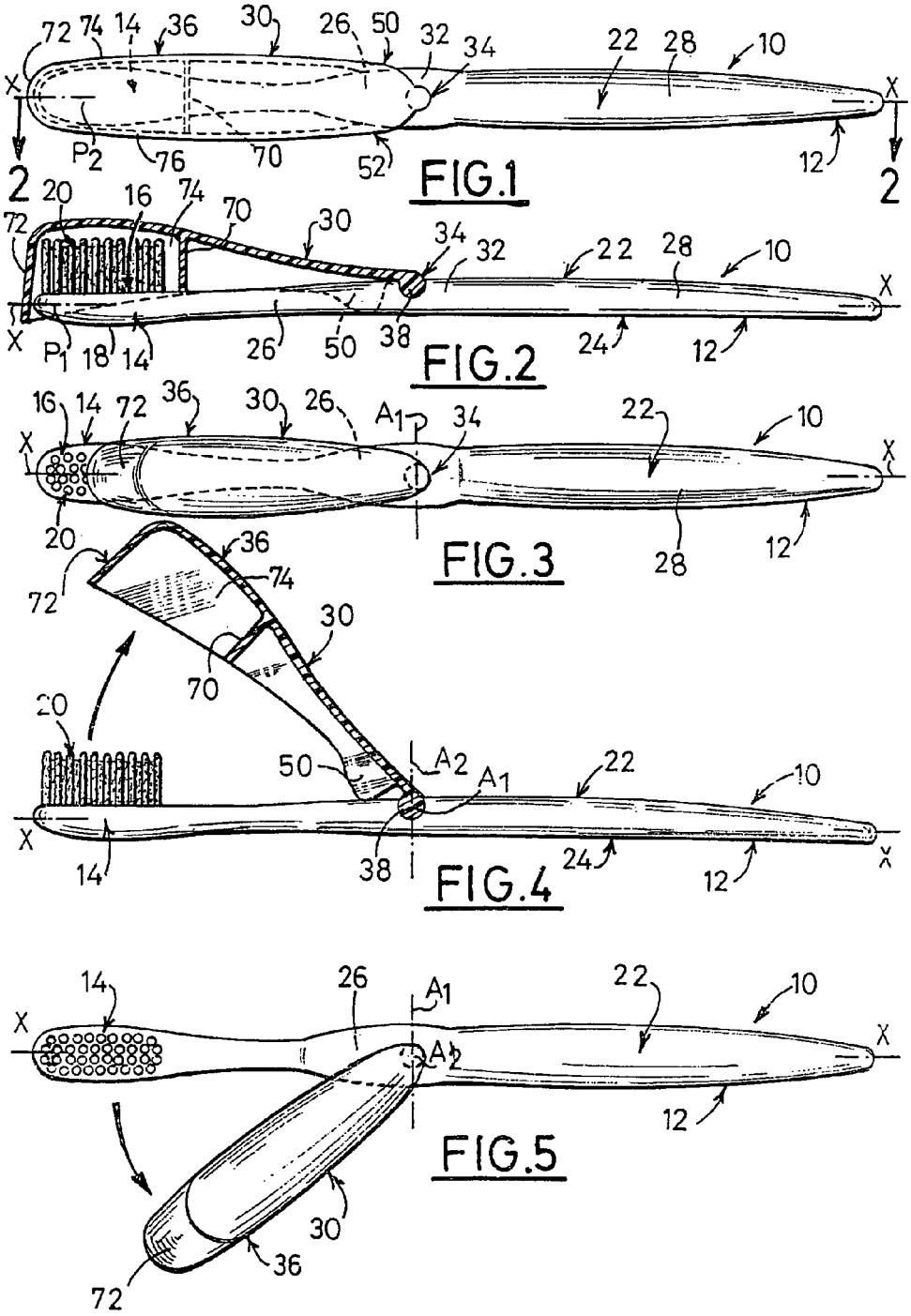
FIG. 1 is a top view diagrammatically showing a toothbrush comprising an articulated arm produced in accordance with the teaching of the invention and depicted in the protective position.
FIG. 2 is a side view in partial longitudinal section along the sectional plane 2-2 which diagrammatically shows the toothbrush of FIG. 1, the articulated arm being in the same protective position.
FIG. 3 is a view similar to that of FIG. 1 showing the toothbrush in a first intermediate position.
FIG. 4 is a view similar to that of FIG. 2 showing the toothbrush in the same position as that of FIG. 3.
FIG. 5 is a view similar to that of FIG. 1 showing the toothbrush as it pivots rearward about the geometric axis A2.

FIGS. 1 and 2 show a toothbrush 10 produced in accordance with the teaching of the invention.

The toothbrush 10 comprises a gripping and manipulation handle 12 which is generally oriented along a longitudinal axis X-X.

The remainder of the description will use, without implying any limitation, a rearward orientation along the longitudinal axis X-X, this corresponding to a left-to-right orientation in FIGS. 1 and 2.

Use will also be made, without implying any limitation, of a vertical orientation, this corresponding to an upward orientation in FIG. 2.

Elements will be deemed to be transverse where they are generally contained in a plane orthogonal to the longitudinal axis X-X.

In one embodiment, the handle 12 is an integral part produced by molding as a single piece.

At the front free end of the handle 12, the toothbrush 10 comprises a brushing head 14.

The head 14 substantially has the shape of a plate lying in a longitudinal plane P1, contained in the plane of FIG. 1, and delimiting two opposed surfaces, which are substantially mutually parallel, and which will be denoted as the upper surface 16 and the lower surface 18, with reference to the vertical orientation of FIG. 2.

The top and bottom of the toothbrush 10 are defined arbitrarily depending on whether the toothbrush is viewed from the side of the upper surface 16 or from the side of the lower surface 18 of the head 14, respectively.

In this case, the upper surface 16 is the surface of the head 14 that bears flexible brushing elements 20.

The flexible brushing elements 20 are for example parallel filaments, or bristles, which extend perpendicularly to the plane of the upper surface 16 of the head 14.

The filaments 20, for brushing the teeth, may be made for example of a thermoplastic such as polyamide or polyethylene, but they may also consist of natural bristles or other similar elements.

The toothbrush 10 in this case includes a plane of symmetry P2, which is vertical and which contains the longitudinal axis X-X.

The filaments 20 are cut for example in a "roof" shape, i.e. the height of the filaments 20 increases from each longitudinal side edge of the head 14 toward the plane of symmetry P2 of the brush 10.

In the remainder of the description, the longitudinal portions of the handle 12 that are generally oriented upward and downward will be called the upper longitudinal surface 22 and the lower longitudinal surface 24, respectively.

A front portion 26 and a rear portion 28 of the handle 12 are respectively defined.

The toothbrush 10 is equipped with an arm 30 one end of which is articulated in a longitudinal region midway 32 along the upper longitudinal surface 22 of the handle 12 and the free end of which, away from the articulation 34, has a protective cover 36 for the brushing filaments 20.

The articulated arm 30 may assume a forward protective position $P_{av}$, shown in FIGS. 1 and 2, in which it is adjacent the upper longitudinal surface 22 of the front portion 26 of the handle 12 and in which the cover 36 covers the brushing filaments 20 so as to protect them from the external environment.

Figure 6:
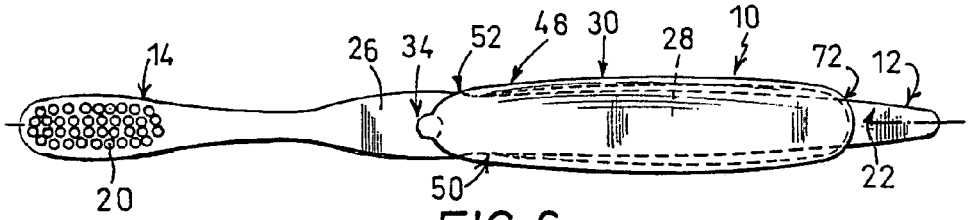
FIG. 6 is a view similar to that of FIG. 1 showing the toothbrush with the articulated arm in the gripping position.
Figure 7:
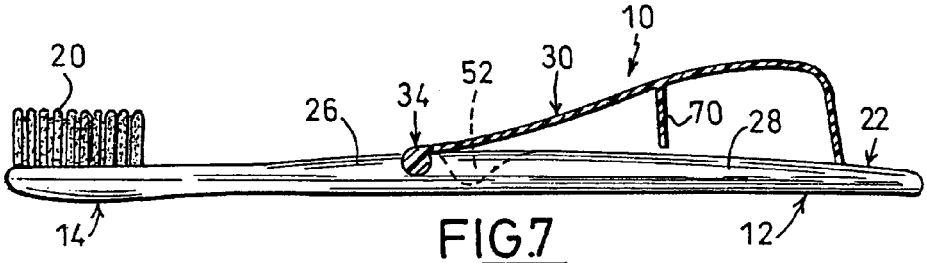
FIG. 7 is a view similar to that of FIG. 2 showing the toothbrush with the articulated arm in the gripping position.

The articulated arm 30 may assume a rear gripping position $P_{ar}$, shown in FIGS. 6 and 7, in which it is adjacent the upper longitudinal surface 22 of the rear portion 28 of the handle 12.

Note that, in FIGS. 2, 4, 7 and 9, only the articulated arm 30 is shown in section.

The general thickness of the arm 30 gradually increases from its articulation 34 as far as the cover 36 such that, when the arm 30 is in the gripping position $P_{ar}$, it forms a profile projecting from the upper longitudinal surface 22 of the rear portion 28 of the handle 12, as can be seen in FIG. 7.

In this position ($P_{ar}$), the arm 30 increases the gripping surface of the handle 12, thus making it easier for the user to manipulate the toothbrush 10, especially when performing a rolling brushing action.

Figure 9:
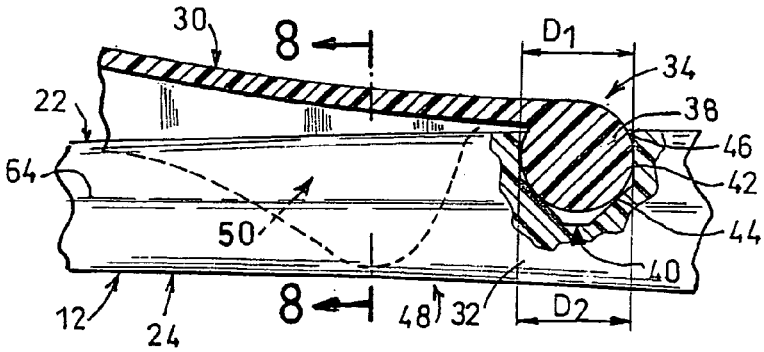
FIG. 9 is an enlarged partial view with cutaway of the articulation of the arm of the toothbrush as shown in FIG. 2.

In accordance with one embodiment of the invention, the articulation 34 of the arm 30 to the handle 12 is a ball-type articulation. A detailed view of this articulation 34 is shown in FIG. 9.

In this figure, in which the arm 30 is shown in the protective position $P_{av}$, it can be seen that the articulation end 34 of the arm 30 comprises a ball 38 which in this case is integral with the arm 30. The ball 38 is force-fitted in a recess 40 of substantially complementary shape made in the upper surface 22 midway 32 along the handle 12.

The recess 40 in this case has the shape of a blind hole having an upper section 42 and a lower section 44, both frustoconical and of substantially vertical axis.

The upper section 42 is very slightly frustoconical, such that its diameter narrows slightly toward the top as far as its upper axial end 46, this end delimiting a circular rim whose diameter D1 is slightly smaller than the maximum diameter D2 of the ball 38. Thus, the ball 38 is retained inside the recess 40 once it has been force-fitted therein.

The lower section 44 in this case is frustoconical and its diameter decreases in the downward direction.

Advantageously, the arm 30 also comprises means 48 for locking via the elastic fitting-together of complementary shapes, so that the user can lock the arm 30 in the protective position $P_{av}$ and in the gripping position $P_{ar}$.

For this purpose, the arm 30 comprises two longitudinal wings 50, 52 which, when the arm 30 is in the protective position $P_{av}$ or the gripping position $P_{ar}$, extend substantially vertically downward on either side of the handle 12.

Figure 8:
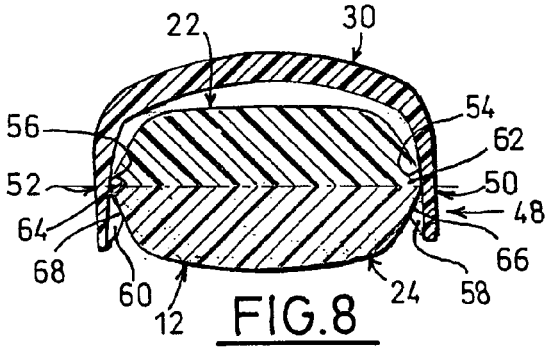
FIG. 8 is a view in cross section along the sectional plane 8-8 which diagrammatically shows how the longitudinal wings of the articulated arm fit together with the handle of the toothbrush.

As can be seen in particular in FIG. 8, each longitudinal wing 50, 52 has, on its inside face 54, 56, i.e. that facing the handle 12, a boss 58, 60 designed to cooperate with a complementary relief 62, 64 borne by the longitudinal side surface 66, 68 facing the handle 12, so as to lock the arm 30 in the relevant position $P_{av}$ or $P_{ar}$.

The joining plane resulting from the molding of the toothbrush 10 is embodied in FIG. 8 by inverting the directions of the hatching between an upper portion and a lower portion of the handle 12.

It is the joining plane that in this case forms the relief 62, 64 on the longitudinal side surfaces 66, 68 of the handle 12. The relief 62, 64 in this case is in the form of a longitudinal boss.

The arm 30 preferably also has a stop element 70 which, when the arm 30 is in the protective position $P_{av}$, extends toward the upper surface 22 of the front portion 26 of the handle 12, so as to prevent the brushing elements from being crushed by the cover 36.

The stop element 70 is in this case formed by a rear transverse wall of the protective cover 36 which rests on the upper surface 22 of the front portion 26 of the handle 12 when the arm 30 is in the protective position $P_{av}$.

The cover 36 is thus delimited by a front transverse wall 72, by two side walls 74, 76 and by the rear transverse wall 70.

Advantageously, the side walls 74, 76 of the cover 36 extend longitudinally toward the ball 38, along the arm 30, so as to form a wide gripping surface when the arm 30 is in the gripping position $P_{ar}$.

In the embodiment represented here, the side walls 74, 76 extend toward the articulation 34 until they form the longitudinal wings 50, 52.

Advantageously, the arm 30, the cover 36, the ball 38 and the longitudinal wings 50, 52 are integral by molding as a single piece.

An explanation will now be given of how the toothbrush 10 according to the invention may be used.

When it is desired to transport the toothbrush 10 or when the toothbrush 10 is not in use, the arm 30 is placed in the protective position $P_{av}$, so that the protective cover 36 completely covers the brushing filaments 20 and isolates them from the external environment.

The rear transverse wall 70 then rests on the upper surface 22 of the handle 12, and the protective cover 36 is thus prevented from pivoting downward and crushing the brushing filaments 20.

The longitudinal wings 50, 52 are fitted over the reliefs 62, 64, which locks the arm 30 in the protective position $P_{av}$, preventing it from accidentally pivoting upward.

When the user wishes to use the toothbrush 10, he takes hold of the articulated arm 30 and pivots it upward, by virtue of the articulation 34, detaching the longitudinal wings 50, 52 from the handle 12, in a first step about a first geometric axis A1, shown in FIGS. 3 and 4, which is substantially transverse and horizontal and which passes generally through the center of the ball 38.

In this first step, the arm 30 pivots into a first intermediate position Pi1, shown in FIGS. 3 and 4, in which the arm 30 generally makes an upward angle of approximately 45° with respect to the longitudinal axis X-X.

The first intermediate position Pi1 generally corresponds to the first position, after pivoting about the first geometric axis A1, in which the longitudinal wings 50, 52 have been brought clear of the handle 12, i.e. they have been raised above the upper longitudinal surface 22 of the handle 12, as shown in FIG. 4.

Note that, in the first intermediate position Pi1, it is also necessary for the lid 36 to be brought clear of the filaments 20, upward, so that the filaments do not obstruct the pivoting of the arm 30 in the second step.

In the second step, starting from the first intermediate position Pi1, the user pivots the arm 30, counterclockwise (as shown in FIG. 5) or clockwise, one half-turn about a second geometric axis A2 which is substantially vertical and which passes generally through the center of the ball 38.

At the end of this second step, the arm 30 is then in a second intermediate position Pi2 (not shown) which is substantially symmetrical with the first intermediate position Pi1 with respect to a transverse plane passing through the articulation 34. The arm 30 then lies in the longitudinal alignment X-X of the handle 12, rearward from the articulation 34.

All that is then required is to pivot the arm 30 downward about the first geometric axis A1, in a third step, so that the arm 30 assumes the gripping position $P_{ar}$ as shown in FIGS. 6 and 7.

The user then has, in this gripping position $P_{ar}$ of the arm 30, an extensive gripping surface, i.e. a larger surface than would be provided by the handle 12 alone, allowing him to perform more difficult brushing actions, such as a rolling brushing action, with comfort.

When the user has finished using the toothbrush 10, he places the arm 30 in the protective position $P_{av}$ once more, by repeating the abovementioned three steps in reverse order.

According to variant embodiments that have not been shown, the ball 38 articulation 34 may be replaced by another kind of articulation allowing the same pivoting movements of the arm 30, at least about the first rotation axis A1 and about the second rotation axis A2.

The ball 38 can for example be replaced by a deformable element made of natural or synthetic plastic, linking the articulation end 34 of the arm 30 to the handle 12.

Note that the geometric shapes of the toothbrush 10 are simple, thus facilitating its production by molding according to known methods.

Furthermore, the toothbrush 10 according to the invention may be used even if the articulated arm 30 is dismantled or damaged.

The invention claimed is:

1. A toothbrush (10) comprising a head (14) placed at a front longitudinal (X-X) end of a handle (12) made overall as a single piece, of the type in which the head (14) has flexible brushing elements (20) on its upper surface (16), of the type which is equipped with an arm (30) one end of which is articulated in a longitudinal region midway (32) along the handle (12), and provided at the opposite free end with a protective cover (36) for the brushing elements (20), such that the articulated arm (30) can assume:

a forward protective position ($P_{av}$) in which the arm (30) is adjacent a front portion (26) of the handle (12) and in which the cover (36) covers the brushing elements (20);

and a rear gripping position ($P_{ar}$) in which the arm (30) is adjacent a rear portion (28) of the handle (12);

of the type in which the general thickness of the arm (3) gradually increases from its articulation end (34) to the cover (36) so as to form a profile projecting from a longitudinal surface (22) of the rear portion (28) of the handle (12), when the arm (30) is in the gripping position ($P_{ar}$), by virtue of which the gripping surface of the handle (12) is increased, and in which the articulation (34) of the arm (30) on the handle (12) is designed to allow the arm (30) to describe at least two different rotations:

a first rotation about a first geometric axis (A1), substantially orthogonal to the longitudinal plane (P1) defined by the upper surface of the head (14); and a second rotation about a second geometric axis (A2), substantially orthogonal to the first axis of rotation (A1), and in which the arm (30) comprises means (48) for locking via elastic fitting-together of complementary shapes, so as to lock the arm (30) at least in its protective position ($P_{av}$), and in which the arm (30) comprises two longitudinal wings (50, 52) which, when the arm (30) is in the protective position ($P_{av}$) or the gripping position ($P_{ar}$), extend vertically downward on either side of the handle (12), and which each have, on their inside face (54, 56), a boss (58, 60) designed to cooperate with a complementary relief (62, 64) on the side surface (66, 68) of the handle (12), as to lock the arm (30) in the relevant position ($P_{av}$, $P_{ar}$)

2. The toothbrush (10) as claimed in claim 1 characterized in that the arm (30) has a stop element (70) which, when the arm (30) is in the protective position ($P_{av}$), extends toward an upper portion (22) of the handle (12), so as to prevent the brushing elements (20) from being crushed by the cover (36).

3. The toothbrush (10) as claimed in claim 1, characterized in that the flexible brushing elements (20) consist of brushing filaments, or bristles.

4. The toothbrush (10) as claimed in claim 1, characterized in that the arm (30) is articulated on an upper portion (22) of the handle (12) via a ball-type connection (34).

5. The toothbrush (10) as claimed in claim 4, characterized in that the articulation end (34) of the arm (30) comprises a ball (38), and in that the ball (38) is force-fitted in a recess (40) of complementary shape made in the upper portion (22) of the handle (12).

6. The toothbrush (10) as claimed in claim 5, characterized in that the ball (38) is integral, by molding as a single piece, with the arm (30) and the cover (36).

* * * * *